US007055293B2

(12) United States Patent
Ours et al.

(10) Patent No.: US 7,055,293 B2
(45) Date of Patent: Jun. 6, 2006

(54) TRANSPORTABLE CONTAINER FOR BULK GOODS AND METHOD FOR FORMING THE CONTAINER

(75) Inventors: David C. Ours, Marshall, MI (US); Randall L. Cary, Battle Creek, MI (US)

(73) Assignee: Kellogg Company, Battle Creek, MI (US)

( * ) Notice: Subject to any disclaimer, the term of this patent is extended or adjusted under 35 U.S.C. 154(b) by 190 days.

(21) Appl. No.: 10/280,969

(22) Filed: Oct. 25, 2002

(65) Prior Publication Data

US 2003/0038055 A1 Feb. 27, 2003

Related U.S. Application Data

(63) Continuation of application No. 09/738,854, filed on Dec. 15, 2000, now Pat. No. 6,494,324.
(60) Provisional application No. 60/170,991, filed on Dec. 15, 1999.

(51) Int. Cl.
*B65B 1/04* (2006.01)

(52) U.S. Cl. ..... 53/399; 441/449; 441/503
(58) Field of Classification Search ..... 53/399, 53/441, 449, 450, 461, 587, 588, 451, 503, 53/504; 206/83.5, 524.1, 524.2, 524.6, 525, 206/526, 527, 597; 383/67, 84, 86, 89, 109, 383/111, 114, 117, 119, 121.1; 426/106, 127
See application file for complete search history.

(56) References Cited

U.S. PATENT DOCUMENTS 2,765,816 A 10/1956 Carter
3,778,962 A 12/1973 James
3,785,410 A 1/1974 Carter
3,928,940 A 12/1975 Fagniart
3,968,626 A 7/1976 Hobbs
4,074,507 A 2/1978 Ruf et al.
4,101,292 A 7/1978 Hogan, II
4,106,261 A * 8/1978 Greenawalt ..... 53/449
4,219,054 A 8/1980 Carter et al.
4,249,639 A 2/1981 Vukovic
4,360,996 A 11/1982 Rutter
4,500,001 A 2/1985 Daniels
4,604,854 A * 8/1986 Andreas ..... 53/552
4,617,683 A * 10/1986 Christoff ..... 383/63
4,648,432 A 3/1987 Mechalas (Continued)

*Primary Examiner*—Jim Foster
(74) *Attorney, Agent, or Firm*—Howard & Howard

(57) ABSTRACT

A transportable container for bulk goods and a method for forming the container are disclosed. The transportable container is formed from a bag having a closed base and an open top. The open top is in a folded over position and a bottom support is located adjacent to the closed base. A particulate material is filled into the bag and an outer wrap is spirally wrapped around the bottom support and the bag such that the outer wrap secures the bag to the bottom support and secures the open top in the folded over position. The method for forming the transportable container includes the steps of securing the open top of the bag in an opened position and supporting a base of the bag. The bag is filled to a predetermined level with a particulate material and while being filled the fill level of the particulate material in the bag is monitored. Simultaneously with filling of the bag, an outer wrap is spirally wrapped around the bag in an upward direction to a predetermined fill level. Once the bag is completely filled the open top of the bag is released and moved into a folded over position whereupon the outer wrap is spirally wound around the bag in a downward direction to secure the open top in the folded over position thereby forming the transportable container.

45 Claims, 7 Drawing Sheets

U.S. PATENT DOCUMENTS

| | | | | | |
|---|---|---|---|---|---|
| 4,706,441 | A | | 11/1987 | Chervalier | |
| 4,734,292 | A | | 3/1988 | Gerardus Van Boxtel | |
| 4,753,060 | A | | 6/1988 | Furukawa | |
| 4,779,402 | A | * | 10/1988 | Duynhoven et al. | 53/529 |
| 4,827,697 | A | * | 5/1989 | Ross | 43/437 |
| 4,909,017 | A | * | 3/1990 | McMahon et al. | 53/410 |
| 5,241,804 | A | * | 9/1993 | Tsuruta et al. | 53/504 |
| 5,354,569 | A | | 10/1994 | Brown et al. | |
| 5,507,859 | A | | 4/1996 | Kaiser | |
| 5,544,472 | A | * | 8/1996 | Koskinen | 53/449 |
| 5,567,048 | A | | 10/1996 | Hammonds | |
| 5,573,044 | A | | 11/1996 | Mechalas | |
| 5,598,387 | A | | 1/1997 | Pohl | |
| 5,598,684 | A | | 2/1997 | Aarts | |
| 5,678,387 | A | | 10/1997 | Aarts | |
| 5,809,744 | A | | 9/1998 | Villines et al. | |
| 5,887,409 | A | | 3/1999 | Leal Pereira Da Silva | |
| 6,012,266 | A | * | 1/2000 | Koskinen et al. | 53/399 |
| 6,131,766 | A | | 10/2000 | King et al. | |
| 6,205,750 | B1 | * | 3/2001 | Koskinen et al. | 53/449 |
| 6,254,519 | B1 | * | 7/2001 | Toshima | 493/214 |
| 6,324,459 | B1 | | 11/2001 | Jung | |
| 6,324,818 | B1 | | 12/2001 | Morness et al. | |
| 6,343,459 | B1 | | 2/2002 | Seaward et al. | |
| 6,371,644 | B1 | * | 4/2002 | Forman | 383/63 |
| 6,393,804 | B1 | * | 5/2002 | Ausnit | 53/412 |
| 2002/0191869 | A1 | | 12/2002 | Stewart et al. | |

* cited by examiner

TRANSPORTABLE CONTAINER FOR BULK GOODS AND METHOD FOR FORMING THE CONTAINER

This application is a continuation of U.S. application Ser. No. 09/738,854, flied Dec. 15, 2000, now U.S. Pat. No. 6,494,324, issued Dec. 17, 2002, which claims the benefit of U.S. Provisional Application No. 60/170,991, filed Dec. 15, 1999.

BACKGROUND OF THE INVENTION

This invention relates generally to a container for transporting bulk goods and, more particularly, to a transportable container comprising a flexible bag for receiving particulate fill material and a spirally wound overwrap for stabilizing the bag.

Typical containers utilized for transport of bulk particulate fill material are inefficient, do not have a very large volume, and often require a large amount of manual labor be used in filling and handling of the container. Also these containers are typically stacked on top of each other during handling and transport, because the containers are not stabilized, this results in damage to the material.

Johnstone et al. discloses in U.S. Pat. No. 5,566,530 method for packaging of irregularly shaped articles, flowable granules, or liquids comprising placing an open framework on a pallet to create a space. The space is filled with the material and then a stretch wrap film is wrapped around the material and the framework. Finally the framework is removed from the film.

Williamson discloses in U.S. Pat. No. 4,113,146 a container comprising a spirally wound film to form an inner container, this is surrounded by a middle layer of spirally wound polyester filament, which is in turn surrounded by an single outer wrap sheet. The ends of the inner container are closed with ties and a support sling is located between the middle and outer layers. In U.S. Pat. No. 4,253,507 Williamson discloses a two ply inner tube covered by an over wrap that is bonded to the inner tube. One end of the inner tube is folded and sealed to form a closed bag like structure.

In U.S. Pat. No. 3,374,599 Sanders discloses a method comprising dropping the materials into a container mounted to a conveyor, placing a continuous tubular thermoplastic netting around the container, sealing one end of the netting, then dropping the netting and material out of the container onto a second conveyor where the other end of the netting is sealed. The netting may subsequently be heated to form a firmer package.

In U.S. Pat. No. 5,353,936 Dockstader et al. discloses a protective tray for use in forming a palletized load of stacked bags of particulate material. The protective tray comprises double wall corrugated cardboard or rigid plastic and in a preferred embodiment it is surrounded by a stretch wrap that encircles the protective tray and the bags.

Connolly discloses in U.S. Pat. No. 4,136,501 a system comprising wrapping a palletized load with a sheet of thermoplastic netting material. Finally, Humphrey discloses in U.S. Pat. No. 4,299,076 a system for wrapping a stabilizing overwrap around a load mounted on a pallet, which is placed on a rotating turntable. The overwrap has a width that is equal to the height of the load and with each rotation the overwrap undergoes successive increasing stages of tension and stretch.

SUMMARY OF THE INVENTION

The present invention provides a transportable container that is a space and cost savings alternative to other know containers. The transportable container of the present invention generates hoop forces on the particulate fill material that immobilize the material in the container, make the container rigid, and prevent the material from shifting during transport thereby preventing damage to the material. The hoop forces promote contact between the particles of the particulate material, thereby both stabilizing and compressing the material, such that the container of the present invention can hold up to three times the amount of particulate material as compared to a conventional tote. Further advantages include reduced contamination of the particulate material, reduced stacking damage, reduced spoiling, and reduced trapping of the material in the container. Finally, the present container allows easy identification of the contents because it is preferably formed from clear materials.

In one embodiment the present invention is a transportable container for bulk goods comprising: a bag having a closed base and an open top, the open top in a folded over position; a bottom support adjacent the closed base; a particulate material in the bag; and an outer wrap spirally wrapped around the bottom support and the bag, the outer wrap securing the bag to the bottom support and the open top in the folded over position.

In another embodiment the present invention is a method of forming a transportable container for bulk goods comprising the steps of securing an open top of a bag in an open position and supporting a base of the bag; filling the bag to a predetermined level with a particulate material; detecting a fill level of the particulate material in the bag; spirally wrapping an outer wrap around the bag in an upward direction up to the predetermined level; releasing the open top of the bag and moving it to a folded over position then spirally wrapping the outer wrap around the bag in a downward direction to secure the open top in the folded over position.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
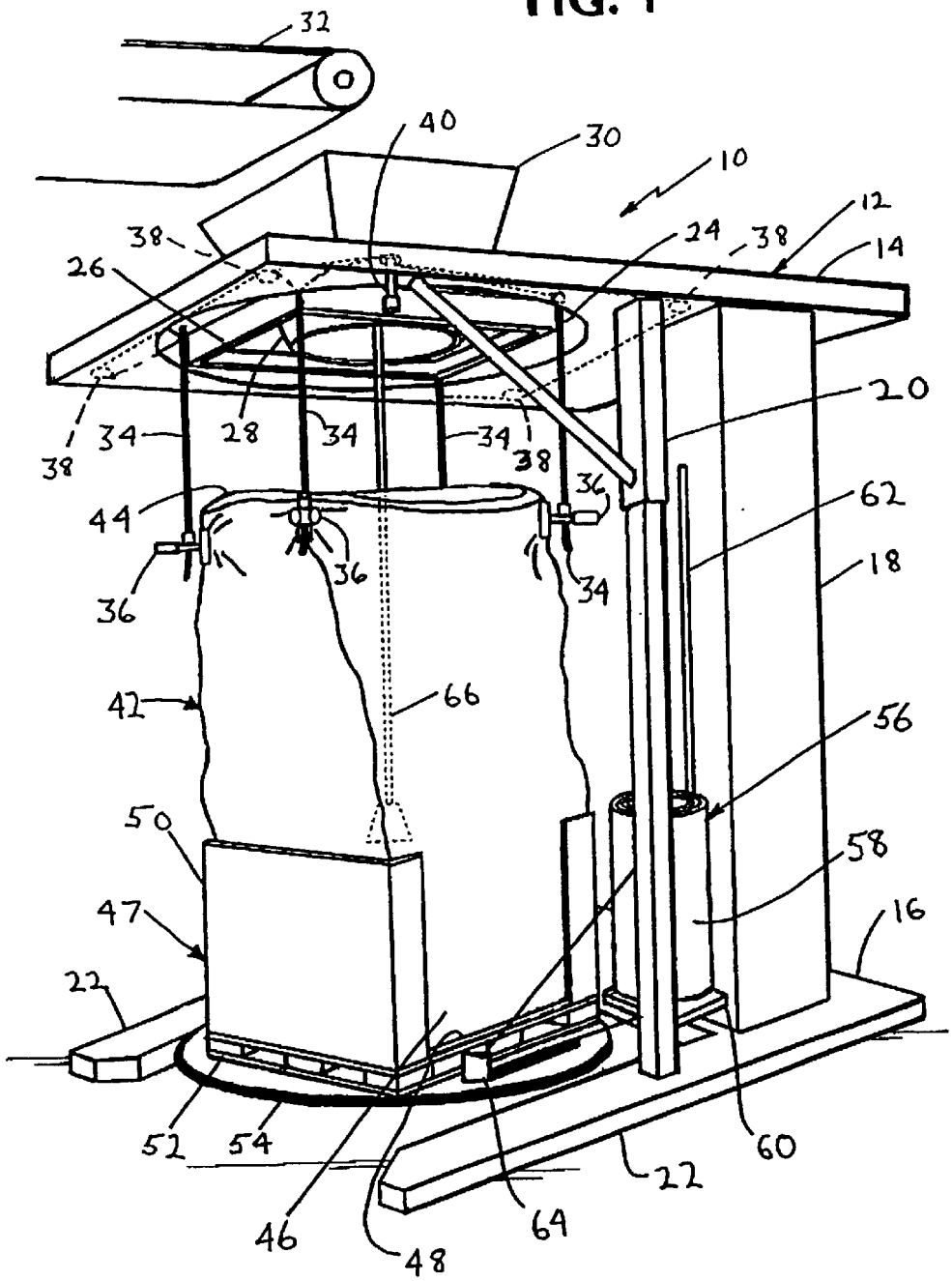
FIG. 1 is a perspective view of a wrapper system according to the present invention with a flexible bag of the present invention in an open position prior to filling and wrapping.

Referring to the Figures, wherein like numerals indicate like or corresponding parts throughout the several views, in FIG. 1, a wrapping system for forming a transportable container for bulk goods designed according to the present invention is shown generally at 10. System 10 includes a frame 12 having an upper support 14 spaced apart from a frame base 16. A first support column 18 and a second support column 20 extend between frame base 16 and upper support 14. Frame base 16 includes a pair of base legs 22. An upper turntable 24 is mounted within upper support 14 of system 10. A support rim 26 is mounted to upper turntable 24 and a fill chute 28 projects through upper turntable 24. A fill funnel 30 is aligned with fill chute 28. A conveyor 32 is aligned above fill funnel 30 for delivering a particular material (not shown) to fill funnel 30. System 10 may comprise a conventional stretch wrapping device such as, for example, a Lantech Q series semiautomatic wrapper.

Extending from upper support 14 are a plurality of cords 34 each of which includes a bag clip 36 at one of its ends. Cords 34 are run through a series of pulleys 38 joined to a crank 40. Rotation of crank 40 moves cords 34 and bag clips 36 up or down relative to upper support 14 depending on the direction of rotation of crank 40. Bag clips 36 are attached to the corners of a flexible bag 42.

Flexible bag 42 includes an open top 44 and a closed base 46. Preferably, bag clips 36 are attached at a position of approximately 50 to 100 inches down from open top 44. It is necessary to allow sufficient length to move the open top 44 into a folded over position (FIG. 3) so that the bag 42 can be sealed, as described below. Bag 42 is preferably a gusseted bag having dimensions of the closed base 46 of from 40 to 48 inches by from 30 to 40 inches. Preferably bag 42 is from 100 to 190 inches long. For a standard pallet size the bag 42 preferably has a base of about 44 inches by about 36 inches and a length of about 178 inches. Bag 42 can be formed from any food grade material, such as for example, low density polyethylene, high density polyethylene, a food grade polymer, or nylon. In a preferred embodiment bag 42 is part of a continuos roll of bags 42.

Closed base 46 rests in a bottom support 47. In a preferred embodiment, bottom support 47 comprises at least a slipsheet 48 and preferably further includes a shroud 50 when the particulate material is very flowable. Slipsheet 48 and shroud 50 can be formed from a variety of known materials, such as for example, corrugated cardboard, plastic, and other similar materials. Shroud 50 preferably has at least two sides and may have more. In addition, shroud 50 may be circular. Shroud 50 can either be attached to slipsheet 48 or it can rest on slipsheet 48. The height of shroud 50 can vary from 4 to 24 inches. Bottom support 47 is mounted to a pallet 50 which rests on a lower turntable 54. Pallet 50 can be formed from metal, wood, plastic, corrugated cardboard and other materials as is known in the art. Preferably the pallet has standard surface dimensions of 40 by 48 inches.

Rotation of lower turntable 54 and upper turntable 24 are synchronized such that they rotate in unison. System 10 further includes a wrap head 56. Wrap head 56 includes a roll of outer wrap 58 and a base 60. Wrap 58 is preferably a stretch wrap having a high cling factor. Preferably wrap 58 is from 90 to 110 gauge and has a width of from 10 to 30 inches. Most preferably, wrap 58 is 100 gauge and has a width of 20 inches. Wrap head 56 is vertically moveable along a guide rod 62. Wrap head 56 is moved up and down guide rod 62 by a motor (not shown). An outer wrap clamp 64 is mounted to a portion of lower turntable 54. A fill sensor 66 is retractably extended into flexible bag 42. In FIG. 1, flexible bag 42 is shown in a pre-loading position and open top 44 is in an open position. A portion of the outer wrap 58 is clamped in outer wrap clamp 64. Outer wrap clamp 64 both holds the initial spiral of outer wrap 58 and cuts outer wrap 58 between formation of transportable containers. System 10 also includes a fill sensor 66 to monitor the fill level in bag 42. In one embodiment the fill sensor 66 is an ultrasonic transmitter and receiver, this sensor 66 is used to monitor the top level of a particulate material 72 in the bag 42. Other sensors 66 are described below.

Figure 2:
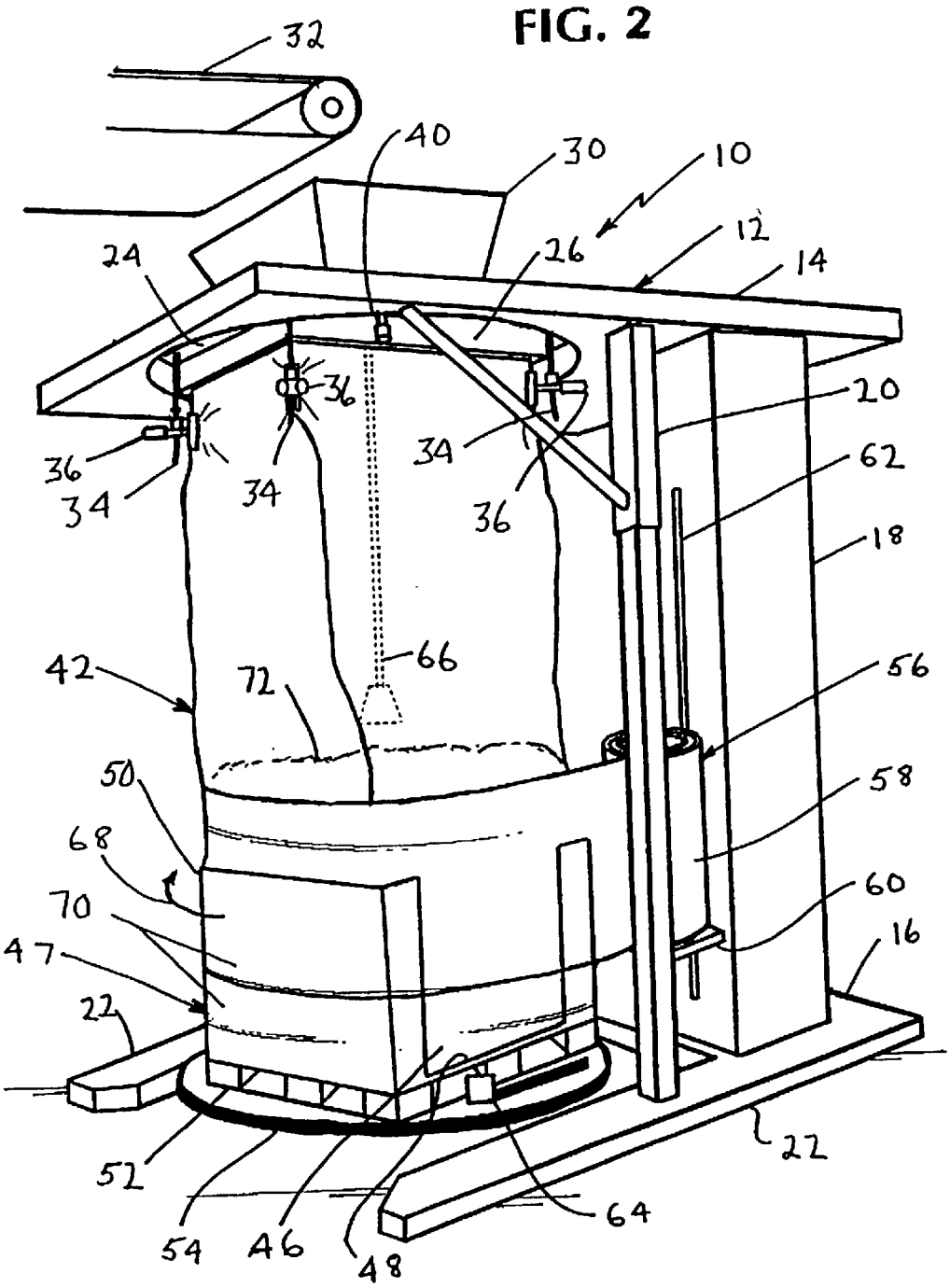
FIG. 2 is a perspective view of the system of FIG. 1 during the filling and wrapping stages.

Once a bag 42 is loaded into system 10 crank 40 is rotated to bring bag 42 to the load position as shown in FIG. 2. As shown in FIG. 2, the upper turntable 24 and lower turntable 54 are rotated in a rotation direction 68 as indicated by the arrow. Initially, the particulate material 72 is run into flexible bag 42 through conveyor 32, fill funnel 30 and fill chute 28. Fill sensor 66 is utilized to detect the height of the particulate fill material 72 within flexible bag 42. As flexible bag 42 fills with particulate fill material 72 the upper turntable 24 and lower turntable 54 are rotated at a speed and the wrap head 56 is moved vertically upward such that the outer wrap 58 is always maintained at a level at or near the top of the particulate fill material 72. In an alternative embodiment, the outer wrap 58 can be rotated around a stationary bag 42. As the bag 42 is filled fill sensor 66 is slowly withdrawn from flexible bag 42. The system 10 can be adjusted to provide overlapping layers of outer wrap 58 spaced apart from 0.5 to 15 inches. The particulate material 72 may comprise any bulk particulate material such as agricultural products, fertilizer, chemicals, plastics, or cereal. When loading food products it is necessary that bag 42 be formed of a food grade material, this is not necessary when the particulate material 72 is a non-food product. In a preferred embodiment system 10 is used to fill bag 42 with either a cereal or a ready-to-eat cereal.

Figure 3:
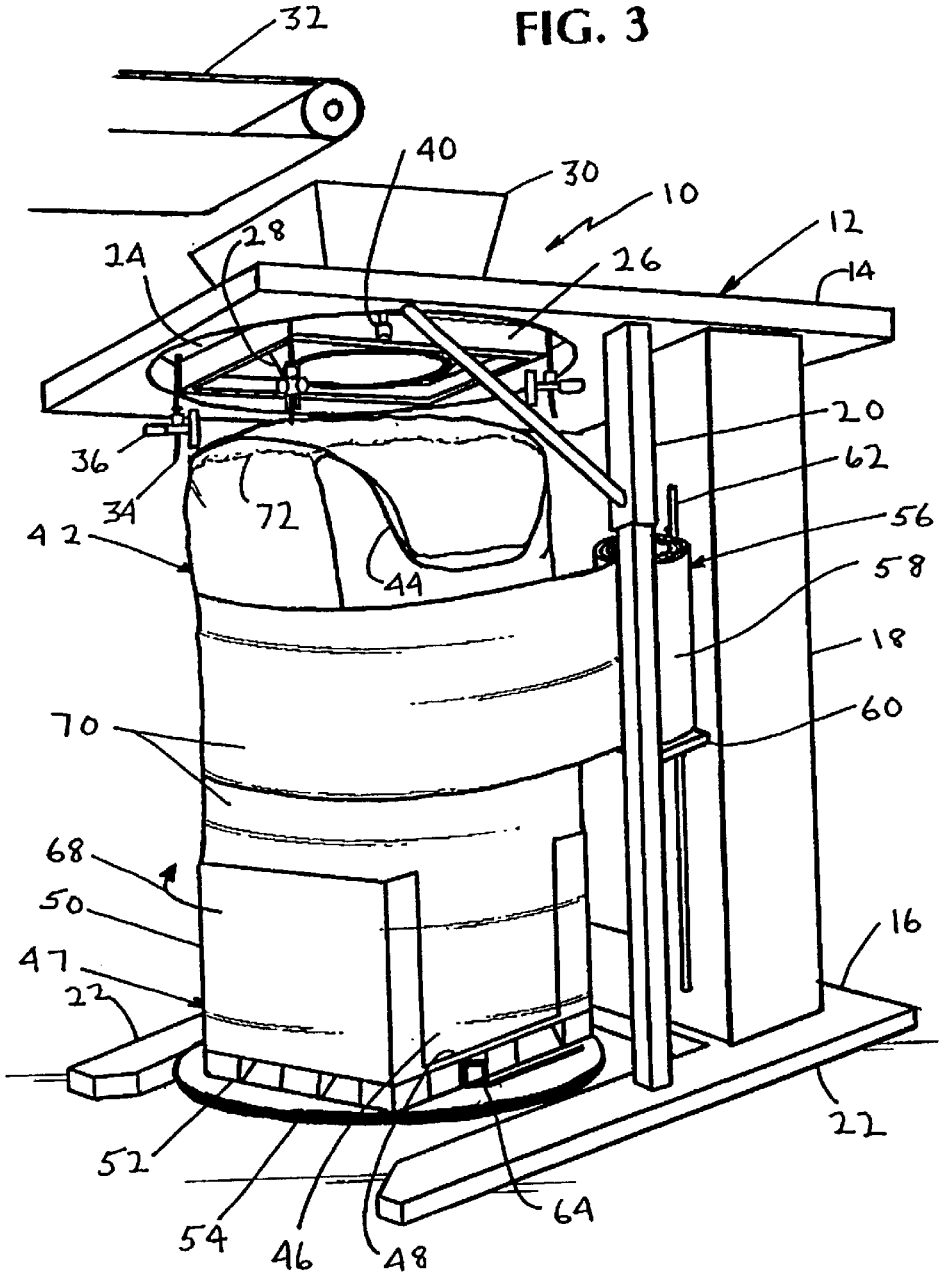
FIG. 3 is a perspective view of the system of FIG. 1 after filling with an open top of the bag in a folded over position.

In FIG. 3 flexible bag 42 is shown in the completely filled condition. At this point, system 10 preferably is stopped such that an operator can unclip flexible bag 42 from bag clips 36 and fold over open top 44 into a folded over position as shown in FIG. 3. In this position, the open top is folded over to seal flexible bag 42. Then, system 10 is again initiated and rotation of the upper turntable 24 and lower turntable 54 is commenced again thereby wrapping additional spiral wrappings of outer wrap 58 around flexible bag 42. It is also possible to adjust system 10 such that wrap head 56 is advanced to the top of the particulate material 72 prior to moving open top 44 to the folded over position, such that the folded over portion only receives downward wrappings of outer wrap 58.

Figure 4:
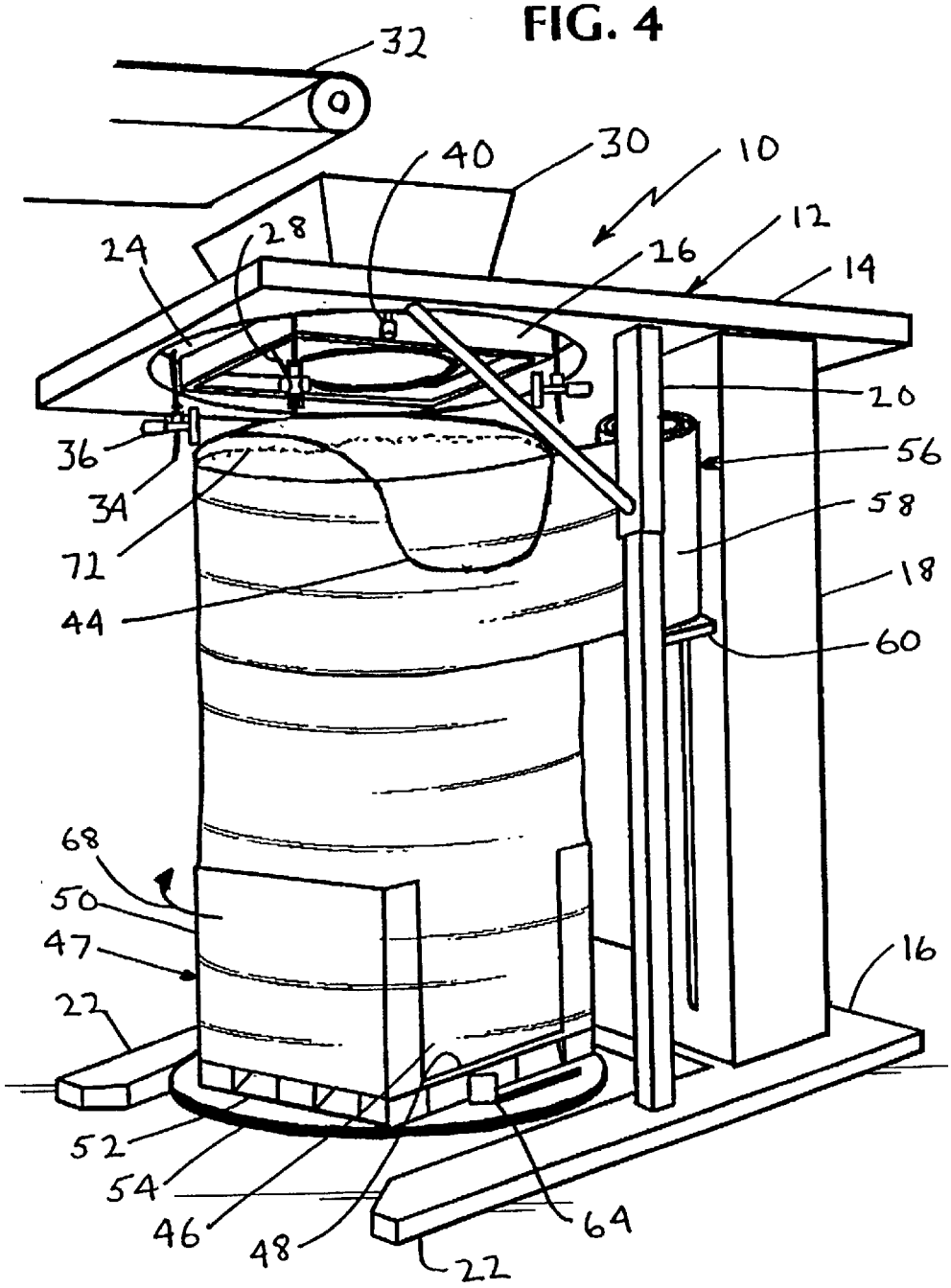
FIG. 4 is a perspective view of the system of FIG. 1 with the bag in the final upward wrapping stage.

In FIG. 4 the system 10 is shown in a position of maximal upward vertical movement of the wrap head 56. At this point, the upper turntable 24 and lower turntable 54 continue to rotate while the wrap head 56 is moved in a vertically downward direction to complete a second wrapping of outer wrap 58 around flexible bag 42. This downward wrapping can be adjusted such that only the bottom support 47 is wrapped to bag 42 or such that pallet 52 is also wrapped to bag 42.

Figure 5:
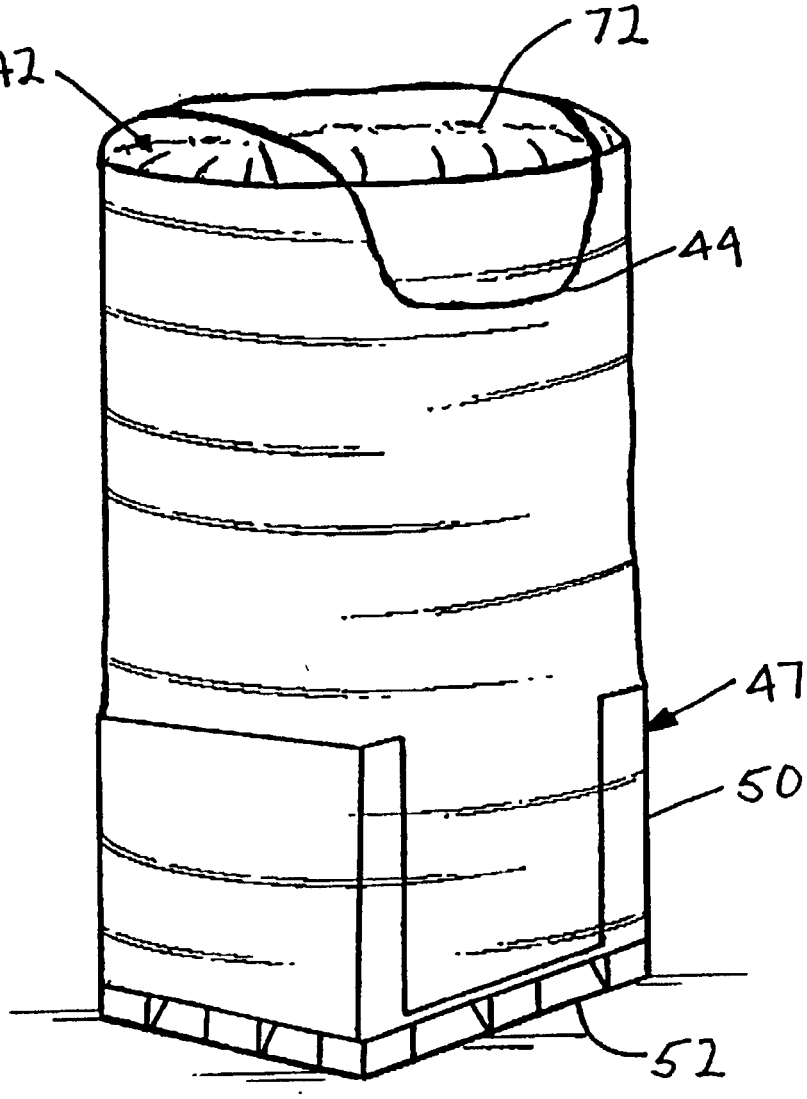
FIG. 5 is a perspective view of the bag in a fully wrapped stage.

In FIG. 5 flexible bag 42 is shown completely wrapped and removed from system 10.

Figure 6:
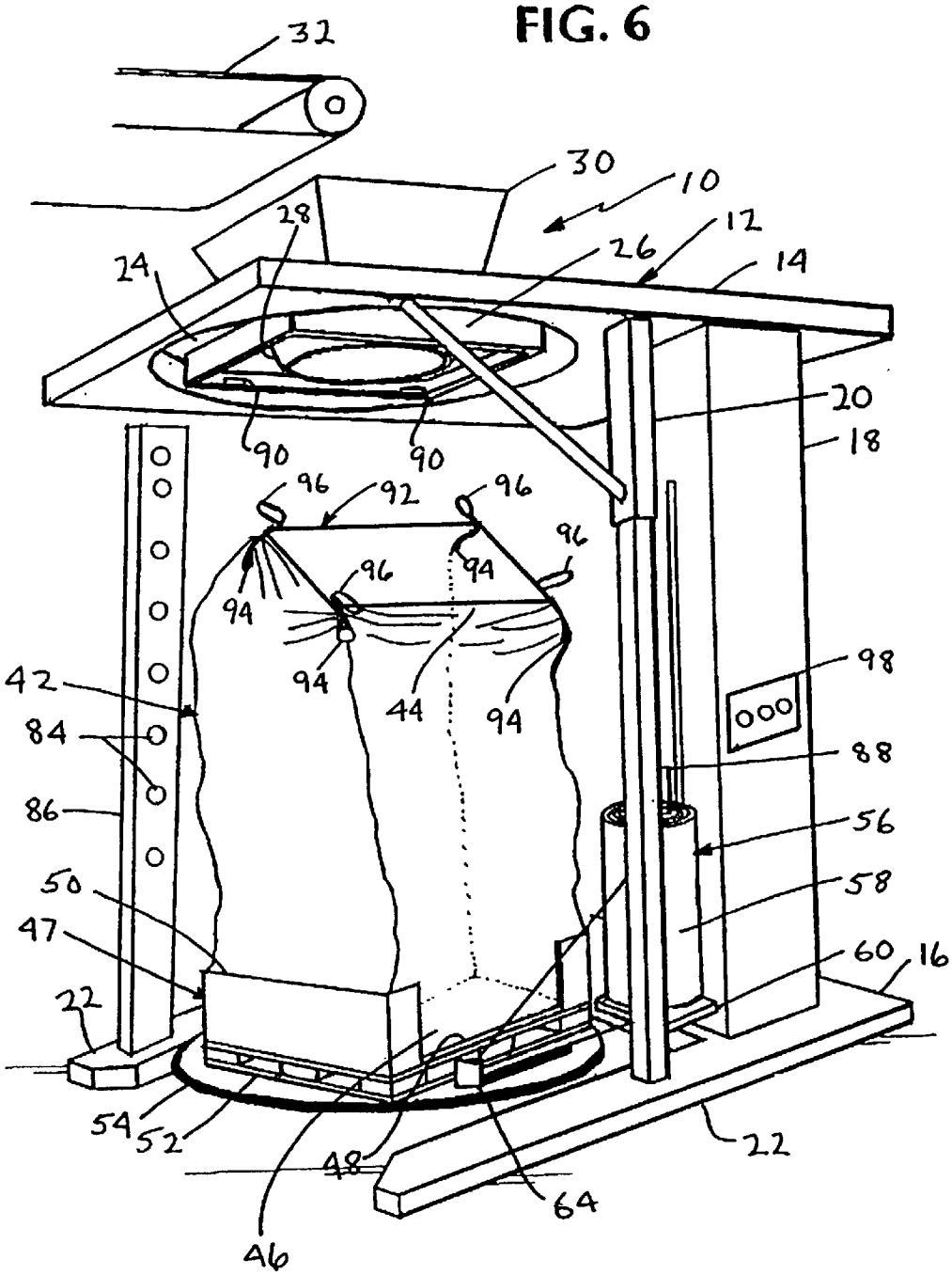
FIG. 6 is a perspective view of an alternative embodiment of the system of FIG. 1.

In FIG. 6 an alternative embodiment of system 10 is shown. In this embodiment, open top 44 of flexible bag 24 is held in an open position by a hoop 92. Hoop 92 includes a plurality of bag holders 94 and a plurality of loops 96 that are received on support rim clips 90 mounted to support rim 26. In this embodiment, system 10 does not include a fill sensor 66 like that described above. Instead system 10 includes a plurality of infrared emitters 84 mounted to s sensor bar 86. Sensor bar 86 is placed across from an infrared detector 88 mounted to wrap head 56. In use, the infrared emitters 84 emit an infrared beam across flexible bag 42 to be detected by infrared detector 88. Thus, infrared emitters 84 and infrared detector 88 serve to sense the level of particulate fill material 72 within flexible bag 42. As in the first embodiment, the upper turntable 24 and lower turntable 54 are rotated as wrap head 56 is moved vertically upward and downward along guide rod 62. The speed of rotation of turntables 24 and 54 are correlated with movement of wrap head 56 along guide rod 62 to ensure that the outer wrap 58 is always approximately level with the top of particulate fill material 72 in flexible bag 42 on the upward spiral. As described above, bag 42 is filled with particulate fill material 72 until it is near the top of flexible bag 42. At this point, hoop 74 is removed from rails 82 and open top 44 is folded over as shown in FIG. 3. Then the procedure continues as outlined in FIGS. 4 and 5, discussed above.

Figure 7:
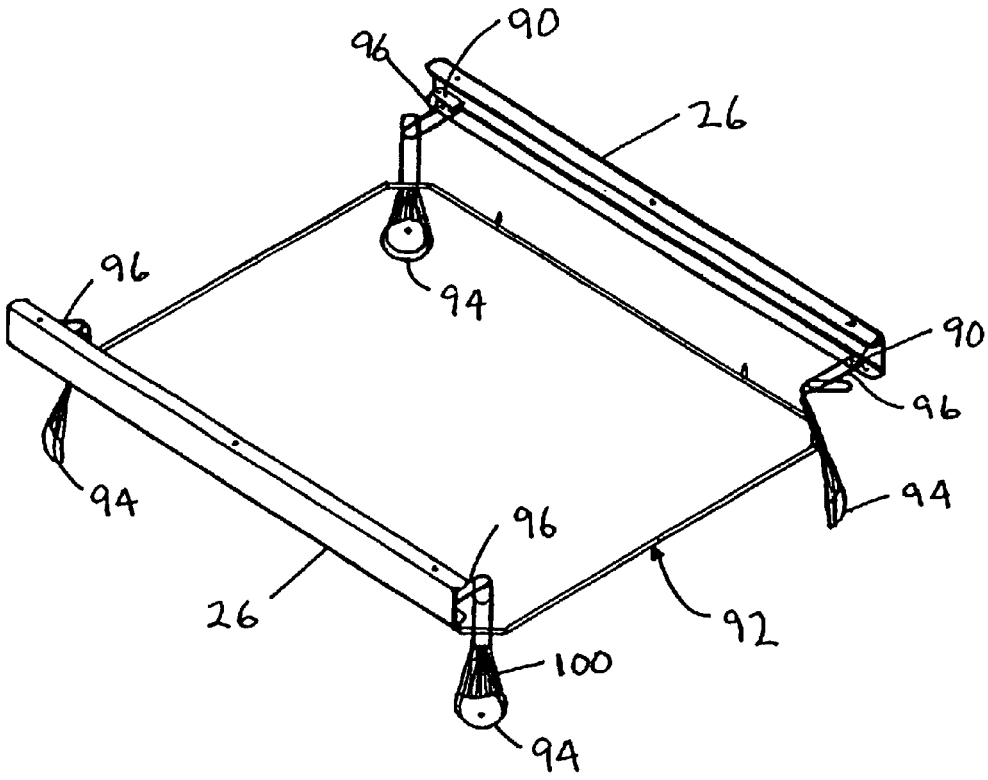
FIG. 7 is a perspective view of a hoop utilized in the alternative embodiment of FIG. 6.

FIG. 7 is a perspective view of hoop 92. The shape of bag holders 94 and loops 96 permit the open top 44 to be bunched while secured to provide sufficient bag to be moved into the folded over position. Preferably bag holders 94 include flexible wire like elements 100 to allow them to be inserted into bag 42 and to then friction hold the bag 42 open.

System 10 preferably includes a control panel 98 to permit an operator to control various functions such as stop, start, rotation speed and wrap head 56 movement speed. Such controls are known in the art. System 10 further includes conventional controls to maintain proper fill level, outer wrap 58 force, and sequencing. The relationship of these parameters is constantly monitored and automatically adjusted by means known in the art.

The wrapping of outer wrap 58 about bag 42 generates what are known as hoop forces which apply a gentle squeeze to the particulate material 72, helping to support it. The hoop forces stabilize the particulate material 72 by promoting controllable contact between the elements of the particulate material 72 being loaded into bag 42, thereby promoting bridging between the particulate material 72. For example, when the particulate material 72 being loaded is a bulk cereal in puff or flake form, hoop forces promote bridging between cereal pieces, thereby reducing the relative motion between the pieces and immobilizing the cereal within bag 42. By using adjustable force settings on the wrap head 56, hoop forces can be tailored to the type of particulate material 72 being inserted in bag 42. Hoop forces allow for a very compact and rigid container, which does not allow the particulate material 72 to shift or get crushed within bag 42. Bag 42 is filled without any internal frame or support means, since the subsequent removal of such a frame or support means would result in the hoop forces being dissipated and also cause dislodging of the particulate material 72 which may result in some of the particulate material 72 being crushed. When shroud 50 is used, preferably the sides of shroud 50 are notched and scored in such a way that the hoop forces can be transmitted to the particulate material 72 without being absorbed by any corners of the shroud 50 or slipsheet 48.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. A method of forming a container comprising the steps of:

a) providing a bag with an open top;

b) filling the bag with a particulate material;

c) monitoring a fill level of the particulate material in the bag while filling the bag; and d) spirally wrapping an outer wrap around the bag in an upward direction while filling the bag, the outer wrap maintained near the fill level of the particulate material.

2. The method as recited in claim 1, wherein step a) comprises providing a bag having a closed base.

3. The method as recited in claim 1, wherein step a) comprises providing a gussetted bag, with outer dimensions of from 40 to 48 inches by 30 to 40 inches, and a height of from 50 to 200 inches.

4. The method as recited in claim 1, wherein step a) comprises providing a bag formed from a polyethylene material, a food grade material, or a nylon material.

5. The method as recited in claim 1, wherein step b) comprises filling the bag with a particulate material comprising cereal flour, cereal, ready-to-eat cereal, agricultural products, fertilizer, chemicals, or plastic resin.

6. The method as recited in claim 1, wherein step d) comprises moving the outer wrap vertically upward at a rate of from 0.5 to 15 inches per spiral wrap around the bag.

7. The method as recited in claim 1, wherein step d) comprises spirally wrapping an outer wrap having a width of from 10 to 30 inches around the bag.

8. The method as recited in claim 1, wherein step d) comprises spirally wrapping an outer wrap having a thickness of from 90 to 110 gauge around the bag.

9. The method as recited in claim 1, further comprising after step d) the further step of spirally wrapping the outer wrap around the bag in a downward direction.

10. The method as recited in claim 1, comprising the further step after step d) of closing the open top of the bag.

11. The method as recited in claim 10, wherein closing the open top of the bag comprises folding over the open top and spirally wrapping the outer wrap around the bag in a downward direction to secure the open top in the folded over position.

12. The method as recited in claim 1 further comprising placing a bottom support adjacent a base of the bag.

13. The method as recited in claim 12 wherein step d) further comprises spirally wrapping the outer wrap around the bottom support and the bag.

14. The method as recited in claim 12 comprising placing a slipsheet, a shroud, or both a slipsheet and a shroud adjacent a base of the bag as the bottom support.

15. The method as recited in claim 14 wherein step d) further comprises spirally wrapping the outer wrap around the bottom support and the bag.

16. The method as recited in claim 14 comprising providing a bottom support formed from corrugated cardboard or plastic.

17. The method as recited in claim 14 comprising providing a slipsheet attached to a shroud as the bottom support.

18. The method as recited in claim 14 comprising providing a shroud having a height of from 4 to 24 inches.

19. The method as recited in claim 12 further comprising placing the bottom support on a pallet.

20. The method as recited in claim 19 wherein step d) further comprises spirally wrapping the outer wrap around a portion of the pallet, the bottom support, and the bag.

21. A method of forming a container comprising the steps of:

a) providing a bag with an open top, wherein step a) comprises attaching the open top of the bag to a plurality of one of clips or clamps at a plurality of points thereby securing the open top of the bag in the open position;

b) filling the bag with a particulate material;

c) monitoring a fill level of the particulate material in the bag while filling the bag; and d) spirally wrapping an outer wrap around the bag in an upward direction while filling the bag, the outer wrap maintained near the fill level of the particulate material.

22. A method of forming a container comprising the steps of:

a) providing a bag with an open top, wherein step a) comprises friction fitting the open top over a hoop thereby securing the open top of the bag in the open position;

b) filling the bag with a particulate material;

c) monitoring a fill level of the particulate material in the bag while filling the bag; and d) spirally wrapping an outer wrap around the bag in an upward direction while filling the bag, the outer wrap maintained near the fill level of the particulate material.

23. A method of forming a container comprising the steps of:

a) providing a bag with an open top;

b) filling the bag with a particulate material;

c) monitoring a fill level of the particulate material in the bag while filling the bag, wherein step c) comprises positioning an ultrasonic transmitter and receiver in the bag to monitor the fill level of the particulate material in the bag; and d) spirally wrapping an outer wrap around the bag in an upward direction while filling the bag, the outer wrap maintained near the fill level of the particulate material.

24. A method of forming a container comprising the steps of:

a) providing a bag with an open top;

b) filling the bag with a particulate material;

c) monitoring a fill level of the particulate material in the bag while filling the bag, wherein step c) comprises positioning a plurality of infrared emitters across from at least one infrared detector for monitoring a fill level of the particulate material in the bag; and d) spirally wrapping an outer wrap around the bag in an upward direction while filling the bag, the outer wrap maintained near the fill level of the particulate material.

25. A method of forming a transportable container for bulk goods comprising:

a) securing an open top of a bag in an open position and supporting a base of the bag;

b) filling the bag to a predetermined level with a particulate material;

c) detecting a fill level of the particulate material in the bag;

d) spirally wrapping an outer wrap around the bag in an upward direction up to the predetermined level; and e) releasing the open top of the bag and moving it to a folded over position then spirally wrapping the outer wrap around the bag in a downward direction to secure the open top in the folded over position.

26. A method as recited in claim 25, wherein step a) comprises attaching the open top of the bag to clips at a plurality of points thereby securing the open top of the bag in the open position.

27. A method as recited in claim 25, wherein step a) comprises friction fitting the open top over a hoop thereby securing the open top of the bag in the open position.

28. A method as recited in claim 25 wherein step a) comprises positioning a lipsheet under the base of the bag thereby supporting the base of the bag.

29. A method as recited in claim 25 wherein step a) comprises positioning a shroud around the base of the bag thereby supporting the base of the bag.

30. A method as recited in claim 25 wherein step b) comprises filling the bag with a particulate material comprising a cereal or a ready-to-eat cereal.

31. A method as recited in claim 25, wherein step c) comprises positioning an ultrasonic transmitter and receiver above the particulate material in the bag and determining the fill level of the particulate material in the bag.

32. A method as recited in claim 25, wherein step c) comprises positioning a plurality of infrared emitters across from an infrared detector for thereby detecting a fill level of the particulate material in the bag.

33. A method as recited in claim 25, wherein steps d) and e) comprise rotating said bag relative to a roll of outer wrap while moving the roll of outer wrap vertically upward thereby spirally wrapping the outer wrap around the bag in an upward direction up to the predetermined level and over the open top in the folded over position.

34. A method as recited in claim 33, wherein step d) comprises moving the roll of outer wrap vertically upward at a rate of from 0.5 to 15 inches per rotation of the bag.

35. A method as recited in claim 25, wherein step d) comprises rotating said bag relative to a roll of outer wrap while moving the roll of outer wrap vertically downward thereby spirally wrapping the outer wrap around the bag in an downward direction.

36. A method for filling a container with a plurality of particles comprising the steps of:

filling a radially flexible container through a large diameter with a plurality of particles to a fill level; and applying a hoop force radially inwardly on the large diameter of the radially flexible container substantially at the fill level as the fill level rises during the filling step.

37. The method of claim 36 wherein the reducing step includes:

sensing the fill level as the fill level rises during the filling step: and radially applying the hoop force at the large diameter in response to the fill level.

38. The method of claim 37 wherein the step of radially applying the hoop force is further defined as engaging the exterior of the flexible container.

39. The method of claim 38 wherein the applying the hoop force step includes generating a compressive force along a perimeter of the flexible container at the fill level.

40. The method of claim 39 including controlling a rate of fill of the filling system and the amount of compressive force.

41. The method of claim 39 including controlling a rate of fill and a location of the application of the compressive force in response to one another.

42. The method of claim 39 wherein the applying the hoop force step includes wrapping a wrap around the flexible container.

43. The method of claim 42 including the step of rotating one of the flexible container and the wrap during the filling step.

44. The method of claim 43 wherein the filling step is further defined the radially flexible container with crushable particles.

45. The method of claim 43 wherein the filling step is further defined as filling the radially flexible container with one of agricultural products, fertilizer, chemicals, plastics and cereal.

* * * * *

UNITED STATES PATENT AND TRADEMARK OFFICE

CERTIFICATE OF CORRECTION

PATENT NO. : 7,055,293 B2
APPLICATION NO. : 10/280969
DATED : June 6, 2006
INVENTOR(S) : David C. Ours et al.

It is certified that error appears in the above-identified patent and that said Letters Patent is hereby corrected as shown below:

Column 8, line 37, Claim 37 ":" should be --;--.

Column 8, line 58 Claim 44 after "defined" insert --as filling--.

Signed and Sealed this

Twenty-first Day of November, 2006

JON W. DUDAS
*Director of the United States Patent and Trademark Office*